United States Patent [19]

Kravchuck

[11] 3,962,556

[45] June 8, 1976

[54] KEYBOARD WITH VERSATILE SWITCH SUPPORT STRUCTURES

[75] Inventor: Robert T. Kravchuck, Lincoln, R.I.

[73] Assignee: Texas Instruments Incorporated, Dallas, Tex.

[22] Filed: Jan. 10, 1975

[21] Appl. No.: 535,529

[52] U.S. Cl. ..... 200/5 R; 200/153 J; 200/159 R; 197/98; 235/145 R

[51] Int. Cl.[2] ..... B41J 5/08; H01H 3/00; H01H 13/62; G06C 7/02

[58] Field of Search..... 200/5 R, 5 A, 159 R–159 B, 200/293–295, 327, 328, 329–340, 153 J; 235/145 R; 197/98

[56] References Cited

UNITED STATES PATENTS

| | | | |
|---|---|---|---|
| 3,663,780 | 5/1972 | Golbeck | 200/153 J X |
| 3,697,713 | 10/1972 | Ohkita | 200/153 J |
| 3,711,685 | 1/1973 | Castle | 235/145 R |
| 3,720,801 | 3/1973 | Yanaga | 197/98 X |
| 3,732,386 | 5/1973 | Ohkita | 200/153 J |
| 3,749,859 | 7/1973 | Webb et al. | 200/275 X |
| 3,749,873 | 7/1973 | Harper et al. | 200/293 |
| 3,824,362 | 7/1974 | Bury | 200/153 J |
| 3,842,229 | 10/1974 | Boulanger | 200/159 R |

*Primary Examiner*—James R. Scott
*Attorney, Agent, or Firm*—John A. Haug; James P. McAndrews; Russell E. Baumann

[57] ABSTRACT

A keyboard has contact pairs on a substrate and has a support with openings therein secured over and spaced from the substrate with the support openings aligned with respective contact pairs on the substrate. Switch mechanisms disposed in the support openings each have a contact member which is movable in a switch housing by a plunger between a depressed position and a retracted position and each switch housing has stop and detent means mounting the mechanism on a support opening so that the contact element bridges a substrate contact pair when the contact element is in depressed position. Some switch mechanisms have a cam on the housing and a cam follower on the plunger for holding the contact element in depressed position until released by manual movement of the plunger and other mechanisms cooperate with guide means mounted in adjacent support openings to mount bar-type key cap means.

25 Claims, 12 Drawing Figures

KEYBOARD WITH VERSATILE SWITCH SUPPORT STRUCTURES

BACKGROUND OF THE INVENTION

Keyboard electrical switches have been commonly used for regulating operation of many different types of electrical apparatus. Usually keys providing several different types of switching action are presented on the same keyboard. However, because the combination of different types of switching actions presented on one keyboard to regulate operation of one type of apparatus has frequently not been suitable for regulating operation of another type of apparatus, individual keyboard structures have tended to be of limited application and have accordingly tended to be somewhat expensive. It would be desirable to provide a keyboard structure which is adapted for mass production and which is adaptable with minor modifications to serve in a wide variety of keyboard applications.

It is an object of this invention to provide a novel and improved keyboard; to provide such a keyboard which incorporates key means providing a variety of switching actions; to provide such a keyboard in which key means providing a variety of switching actions are combined in any selected combination; and to provide such a keyboard which is characterized by a reliable and economical structure.

BRIEF DESCRIPTION OF THE DRAWING

Other objects, advantages and details of the novel and improved keyboard of this invention appear in the following detailed description of the invention, the detailed description referring to the drawings in which.

DESCRIPTION OF PREFERRED EMBODIMENTS

Figure 1:
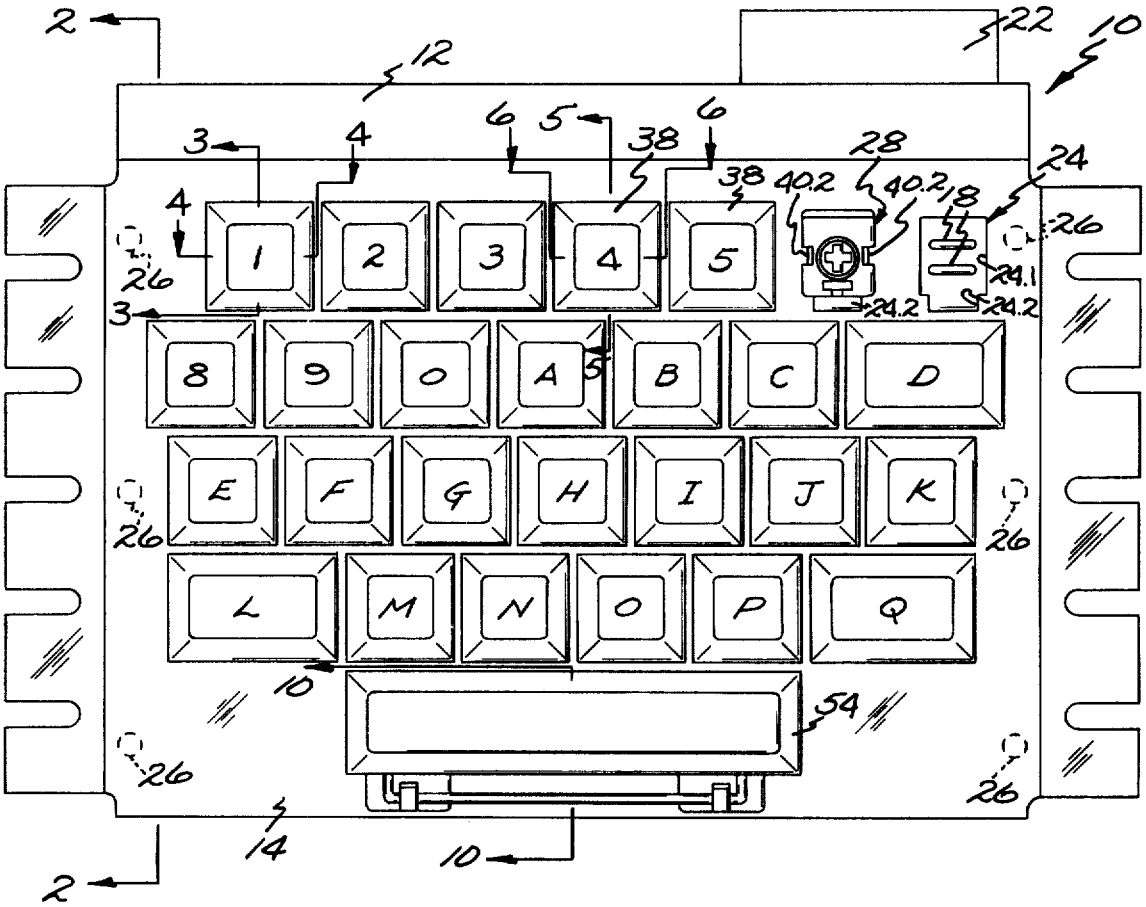
FIG. 1 is a plan view of the keyboard of this invention with some components removed to illustrate keyboard assembly steps.
Figure 2:
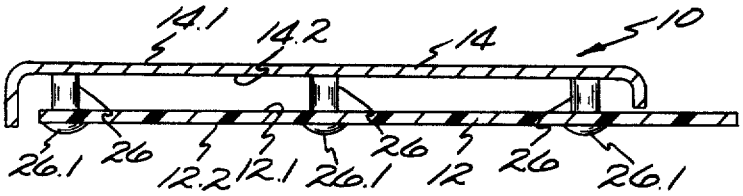
FIG. 2 is section view along line 2—2 of FIG. 1.
Figure 4:
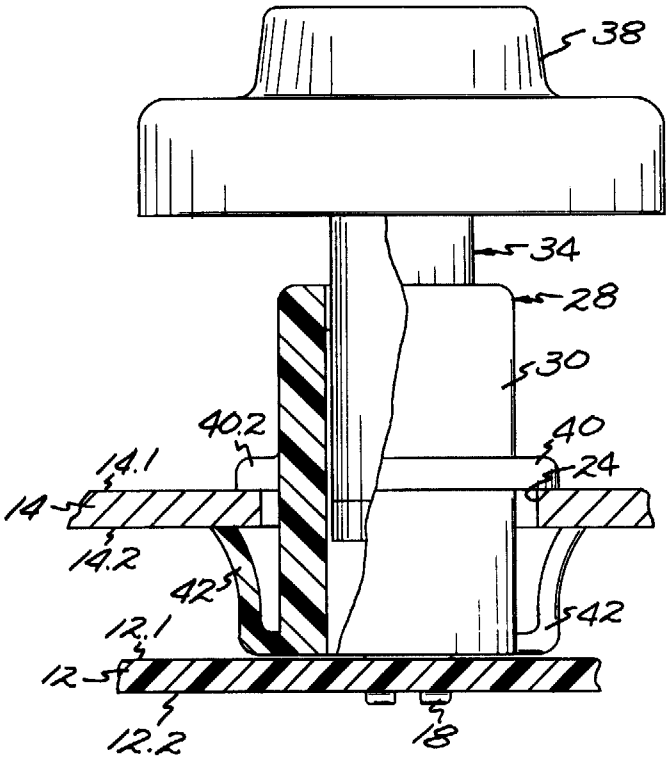
FIG. 4 is an enlarged partial section view along line 4—4 of FIG. 1.

Referring to the drawings, 10 in FIGS. 1 and 2 indicates the novel and improved keyboard of this invention which is shown to include a flat, sheet-like substrate 12 and a support member 14 secured in selected spaced relation to the substrate. In accordance with this invention, the substrate 12 preferably comprises a conventional printed circuit board having a plurality of pairs of staples 18 disposed in a selected pattern on the substrate to extend through the substrate. In this arrangement, (best seen in FIGS. 3 and 4) portions of each pair of staples 18 are disposed at one side 12.1 of the substrate to serve as a pair of spaced electrical contacts whereas other portions of the pair of staples are disposed at the opposite side 12.2 of the substrate and are connected to conventional printed circuit paths (indicated only at 20 in FIG. 3) on that opposite side of the substrate. As will be understood, any desired pattern of pairs of staples is provided on the substrate to provide any desired number of pairs of keyboard contacts and any desired circuit paths 20 are provided on the substrate for connection to the contacts, the substrate preferably including a portion 22 to which connections can be made for connecting the keyboard circuit paths to an electrical apparatus to be regulated.

In accordance with this invention, the support member 14 preferably comprises a rigid, sheet-like member, preferably of a metal material, having a plurality of openings 24 therein (see FIG. 1), the support member being disposed with the openings 24 aligned with respective pairs of contacts 18 on the substrate 12 as is also illustrated in FIG. 1. Preferably, each of the support openings 24 is of a keyhole shape including a main portion 24.1 and a slot portion 24.2 as shown in FIG. 1. Preferably, as shown in FIG. 2, hollow cylindrical spacers 26 are disposed between the support 14 and the substrate 12 and screw means 26.1 are passed through apertures in the substrate and through the spacers 26 to threadedly engage the support 14 for securing the support member in selected, spaced relation to the substrate. Alternately, any other conventional means are used for securing the support in selected spaced relation to the substrate.

Figure 3:
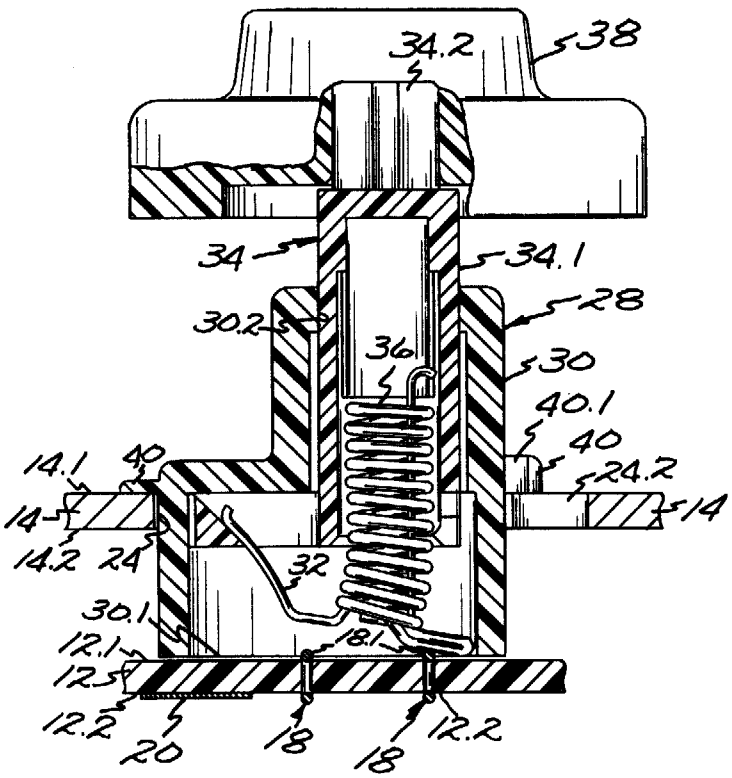
FIG. 3 is an enlarged partial section view along line 3—3 of FIG. 1.
Figure 6:
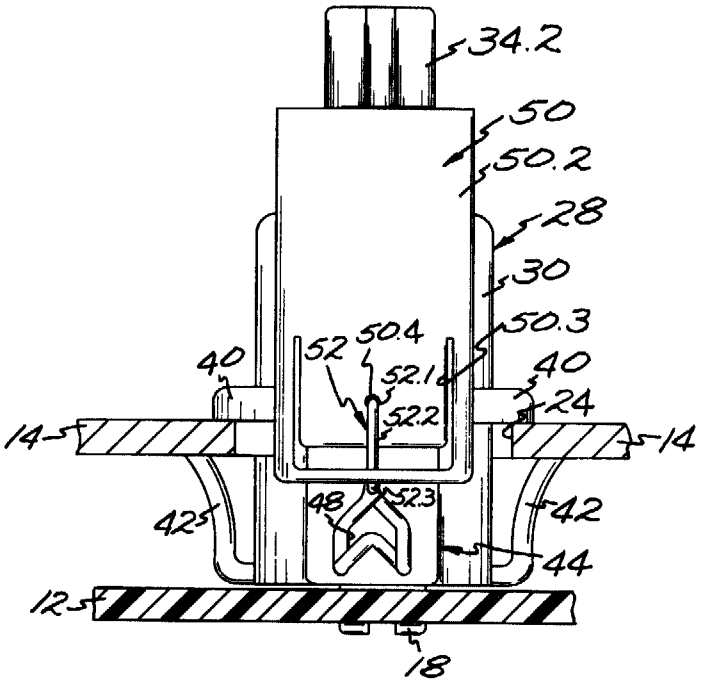
FIG. 6 is an enlarged partial section view along line 6—6 of FIG. 1.

In accordance with this invention, a plurality of switch mechanisms 28 are disposed in respective openings 24 in the support member 14. See FIG. 1. As is best shown in FIG. 3, each of the switch mechanisms 28 includes a housing 30 of electrically insulating material having an open end 30.1 and having an aperture 30.2 opposite the open housing end. Each mechanism 28 also includes a contact bridging member 32 which is movable within the housing 30 between a depressed position in which the bridging member bridges a pair of the electrical contacts 18 at the open housing end and a retracted position shown in FIG. 3 wherein the bridging member is spaced from at least one of that pair of contacts. The switch mechanism 28 also includes a plunger 34 which is movable within the housing to move the bridging member to its depressed position and includes spring means 36 which normally bias the plunger to move the bridging member to its retracted position. As shown in FIG. 3, the plunger 34 of the switch mechanism has a neck portion 34.1 extending from the plunger through the housing aperture 30.2. A manually depressible key cap 38 is then secured to the plunger neck to be accessible from the top of the keyboard 10. Preferably, as shown, the plunger has a keyed portion 34.2 at the end of the plunger neck press-fitted into corresponding slots in the key cap means 38 for securing the cap to the plunger. As the key switch mechanism 28 as thus far described is known and is shown in U.S. Pat. No. 3,842,229, the switch mechanism components thus far noted are not further described herein and it will be understood that manual depressing of the key cap 38 is effective to move the bridging member 32 to its depressed position through movement of the plunger 34 but that on release of manual pressure on the key cap, the plunger is moved in response to bias of the spring means 36 to return the bridging member to its retracted position. In accordance with this invention, however, the switch mechanism housing 30 is provided with a stop flange 40 extending therearound intermediate the housing aperture 30.2 and the open housing end 30.1. In addition, resilient detent arms 42 are provided on the housing extending toward the stop flange 40. Preferably, the stop flange on each of the switch mechanism housings has a key-hole shaped slot 40.1 therein as is best illustrated in FIG. 1, this slot being provided for a purpose to be described below. Further the flange 40 is perferably provided with slots 40.2 to facilitate provision of the detent arm 42 on a molded housing 30.

In this arrangement of the switch mechanism 28, the switch mechanisms are adapted to be pressed into respective openings 24 in the support member 14 for resiliently pressing the detent arms 42 toward the mechanism housing 30 until the stop flange 40 on the housing is engaged with surface portions 14.1 at one side of the support member around the opening 24. See FIG. 3. At this point, when the stop flange 40 is engaged with the support member 14, the detent arms are adapted to spring back to engage the arms with other surface portions 14.2 on the support member around the opening 24. See FIG. 4. In this way, the stop flange and detent arms cooperate with the fit of the housing 30 in the main portion 24.1 of the support opening 24 for precisely positioning each support mechanism 28 in a precisely predetermined position relative to a pair of contacts 18 on the substrate 12. In this way, the keyboard 10 is provided with key switch means which are normally open but which are adapted to be manually closed and to be retained in a closed position only while manual pressure is maintained on the key cap 38 attached to the switch mechanism.

Figure 7:
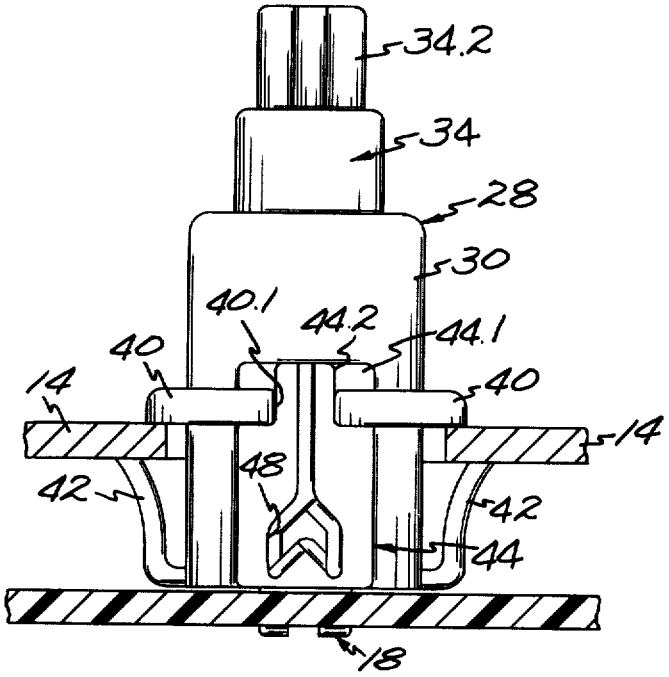
FIG. 7 is a view similar to FIG. 6 with a component removed.
Figure 8:
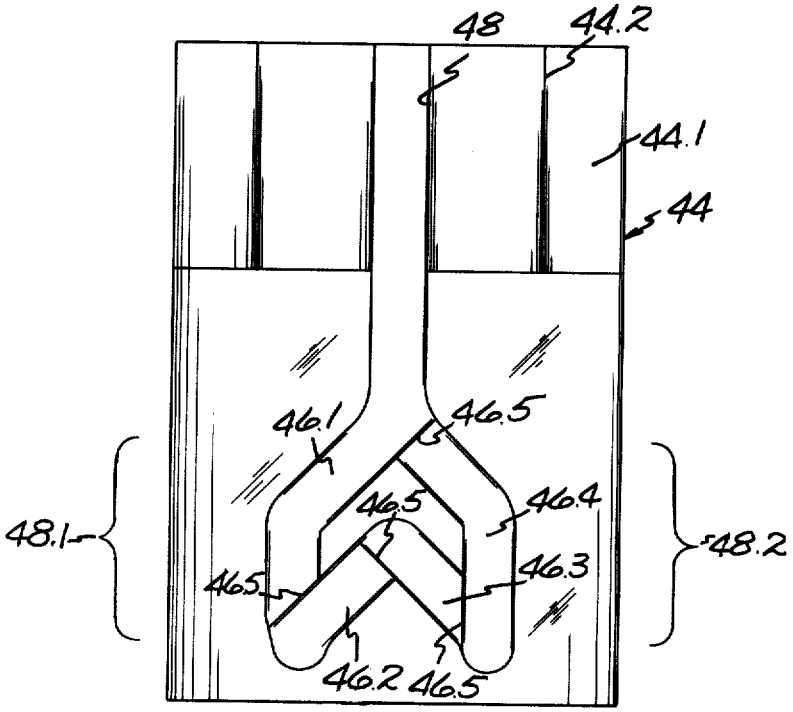
FIG. 8 is a further enlarged partial view similar to FIG. 7.
Figure 9:
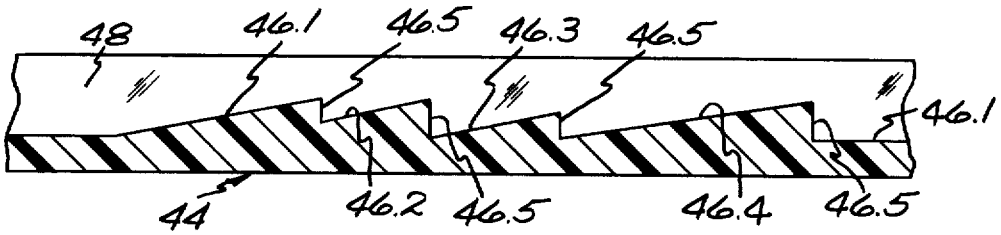
FIG. 9 is a developed view of a cam surface illustrated in FIG. 8.

In accordance with this invention, some of the switch mechanisms 28 are also adapted to provide the alternate action type of switching function as is illustrated in FIGS. 5–9. That is, some of the switch mechanisms 28 are provided with a cam block means 44 which are secured to switch mechanism housings 30 and with cam follower means 45 which are secured to switch mechanism plungers as shown in FIGS. 5–9. Thus, the cam block 44 is provided with a key portion including a key plate 44.1 and a key rib 44.2 and has said key portion of the cam block press-fited into the key-hole shaped slot 40.1 in the stop flange on a switch mechanism housing, thereby to secure the cam block to the housing. If desired, the cam block 44 is molded as an integral part of the housing 30. The cam block is provided with a plurality of cam riser surfaces 46.1, 46.2, 46.3 and 46.4 which are separated by alternate cam shoulders 46.5 as is best shown in FIGS. 7–9. As shown in FIG. 7 these cam riser surfaces are recessed in a groove 48 in the cam block to define a closed loop cam path and the cam riser surfaces are each provided with a common riser direction around that closed loop path as is best illustrated in the developed view of said cam riser surfaces shown in FIG. 9.

Figure 5:
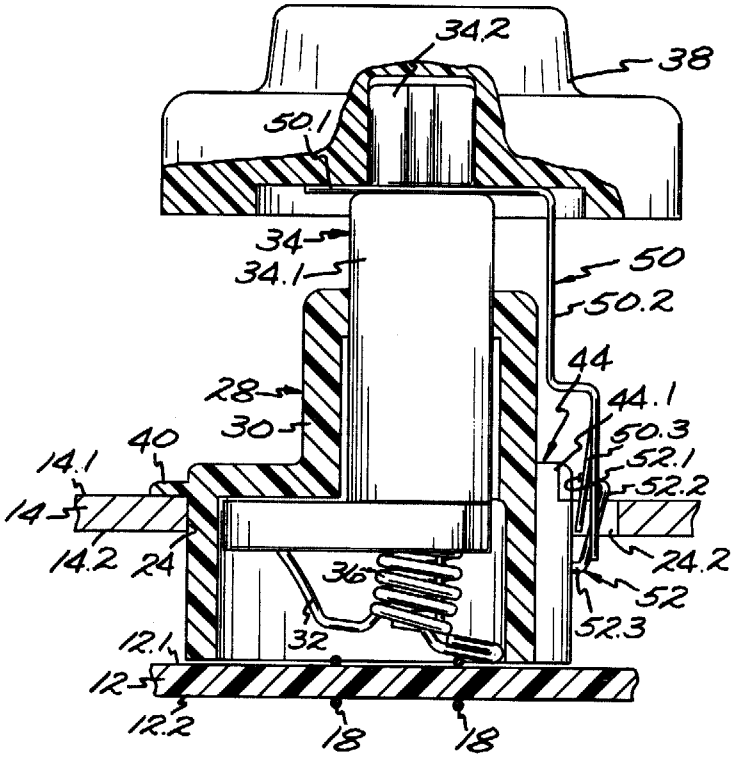
FIG. 5 is an enlarged partial section view along line 5—5 of FIG. 1.

In accordance with this invention, the cam follower means 45 preferably comprises a generally L-shaped spring member 50 having one leg 50.1 apertured to fit over the key portion 34.2 of the plunger in the switch mechanism 28 and to be retained on the plunger by the key cap 38. The L-shaped spring also has a second leg 50.2 extending over the cam block 44, the spring leg 50.2 having a central spring blade 50.3 which is separated from the center of the leg 50.2 and which is provided with an aperture 50.4. A C-shaped cam follower element 52 is then disposed with one end 52.1 disposed in the aperture 50.4, with the main body 52.2 of the element captured between the spring blade 50.3 and the remainder of the spring leg 50.2, and with the opposite end 52.3 fitted into the groove 48 in the cam block. In this arrangement as is shown in FIG. 5, the leg 50.2 of the cam follower spring extends through the slot portion 24.2 of the support member opening 24 in which the mechanism 28 is mounted.

In this arrangement of the cam block 44 and cam follower 45, the cam follower element 52 is adapted to be moved in only one direction through the groove 48 in the cam block. That is, when key cap 38 or the switch mechanism 28 is depressed while the mechanism is in the position shown in FIG. 6, the follower element 52 is moved along the cam riser surface 46.1 until it drops over the first cam shoulder 46.5 in the groove 48. When manual pressure on the key cap is then released, the cam element is prevented from returning along riser surface 46.1 by the first cam shoulder and is moved along riser surface 46.2 in response to bias of the spring 36 acting on the plunger 34 until the follower element drops over the second cam shoulder 46.5 in the groove 48. At that point, further movement of the cam follower element, and therefore of the plunger 34 is prevented by engagement of the follower element with the edge of the groove 48. Then, when manual pressure is again applied to the key cap 38, the follower element is moved along riser surface 46.3 until the follower element drops over the third cam shoulder 46.5 in the groove 48. At that point, when manual pressure on the key cap is released, the follower element is moved along cam riser surface 46.4 in response to bias of the spring 36 on the plunger 34 until the follower element drops over the fourth cam shoulder 46.5 in the groove 48 and returns to its original position. As will be understood, the fourth cam shoulder prevents the follower element from moving along the cam riser surface 46.4 when the key cap 38 is again depressed and assures that the cam follower element is restricted to one-way movement around the groove 48. In accordance with this invention, the groove 48 is provided with two major portions 48.1 and 48.2 (see FIG. 8) which are interconnected by two shorter minor portions of the groove. These groove portions are provided with selected lengths so that, when manual pressure is initially provided on the key cap means 38 for moving the bridging member of the switch mechanism to its depressed position engaging a pair of contacts on the substrate 12, the cam follower element 52 moves through one major portion 48.1 of the groove 48 along cam riser surface 46.1 to permit such movement of the bridging member. When manual pressure is then removed from the key cap, only limited movement of the cam follower is permitted to move the follower over cam riser surface 46.2 without moving the bridging member out of its depressed positon. That it, the spring 36 permits limited movement of the plunger 34 but the follower limits such movement so that the bridging member continues to bridge a pair of contacts on the substrate 12. Then, when manual pressure is again applied to the key cap 38, further limited movement of the follower is permitted along cam riser surface 46.3 so that when key cap pressure is again released, movement of the cam follower element through the second major portion 48.2 of the groove along riser surface 46.4 permits the bridging member to return to its retracted position in response to bias of the spring 36. In this way, the addition of the cam block 44 and cam follower means 45 to the switch mechanism 28 adapts such mechanism for the alternate type of switching action.

Figure 10:
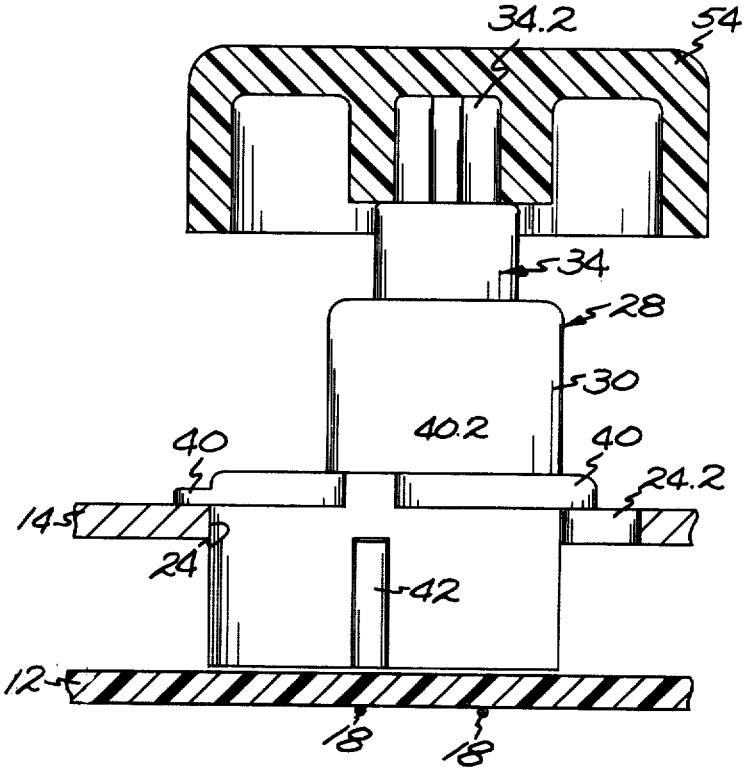
FIG. 10 is an enlarged partial section view along line 10—10 of FIG. 1.
Figure 11:
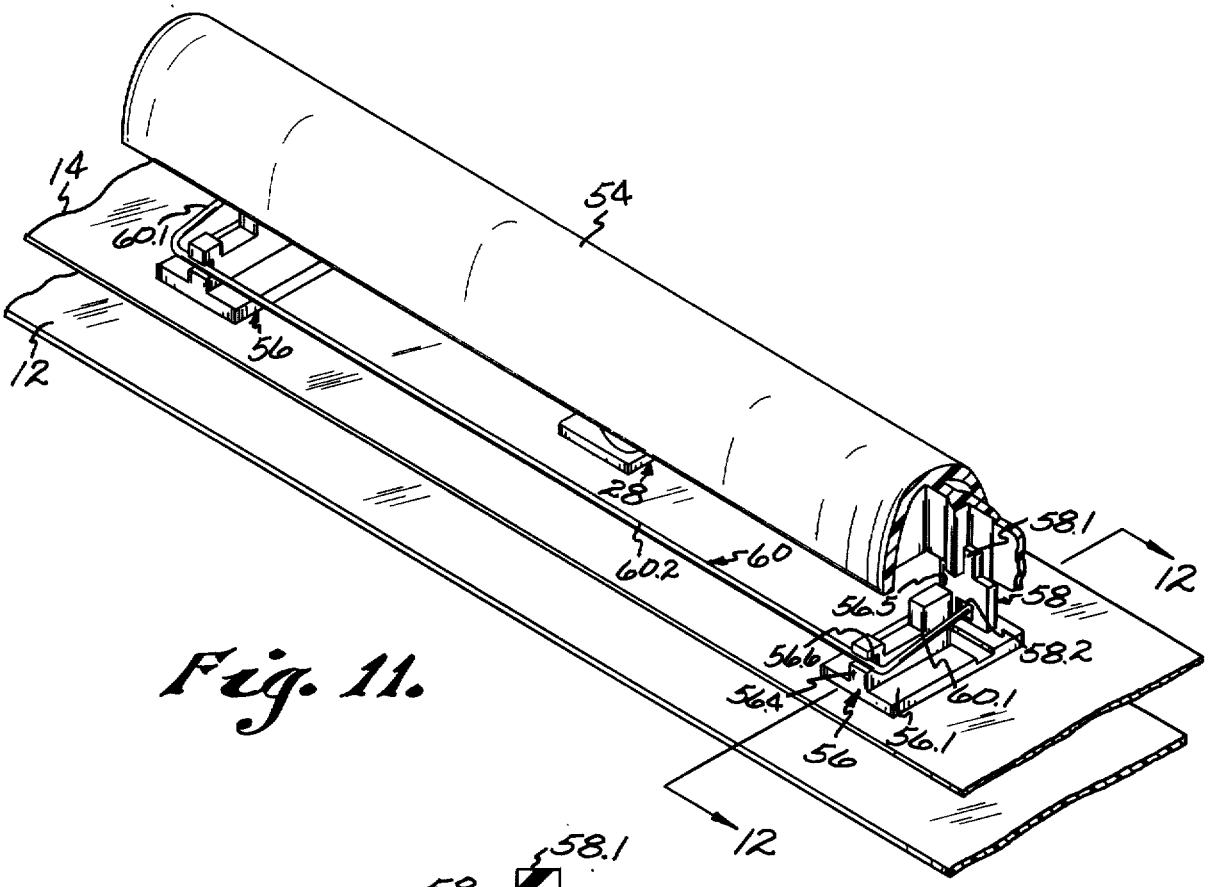
FIG. 11 is an enlarged partial perspective view of the keyboard illustrated in FIG. 1.
Figure 12:
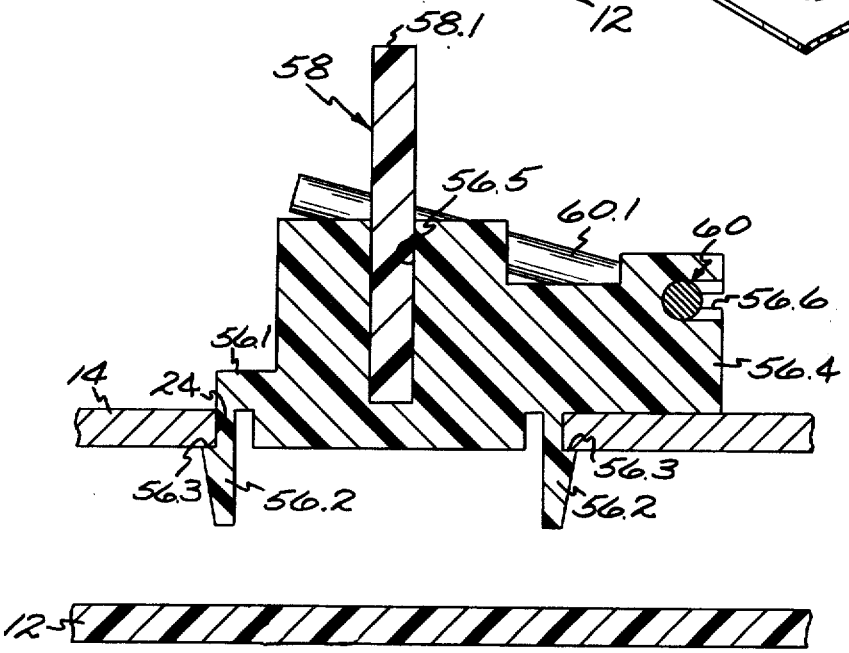
FIG. 12 is a partial section view along line 12—12 of FIG. 11.

In accordance with this invention, at least one of the switch mechanisms 28 is provided with a bar-type of key cap means as is best shown in FIGS. 10–12. Thus, as is best shown in FIG. 10, the key cap means 38 on one mechanism is replaced with a key cap 54, this key cap 54 having a bar-shape as best shown in FIG. 11. As illustrated in FIG. 10, the key cap 54 is secured to the plunger 34 of the mechanism in the same manner as the key cap 38 and the switch mechanism is mounted in an opening 24 in the support member 14 as above-described with reference to others of the switch mechanisms. Accordingly, movement of the key cap 54 is adapted to move the switch mechanism to which it is secured in the same manner as has been above-described. In accordance with this invention, however, the key cap 54 is also provided with means to assure that manual pressure applied to any part of the key cap 54 is uniformily transmitted to the switch mechanism 28. Thus, in accordance with this invention, two spring guides 56 are each provided with a flat flange portion 56.1, with resilient detent arms 56.2 depending from the flange portion, with shoulders 56.3 near the ends of the detent arms and with a central rib portion 56.4, this central rib having a slot 56.5 therein at the top of the rib and having a second slot 56.6 at one end of the rib. These spring guides are then forced into openings 24 in the support member 14 so that the flange portions of the guides engage surfaces of the support 14 around the opening 24 at one side 14.1 of the support and so that the detent arm shoulders 56.3 engage surface portions of the support around the opening 24 at an opposite side 14.2 of the support, thereby to securely mount the guides on the support 14. Slides 58 each having a keyed portion 58.1 press-fitted in corresponding slots at opposite ends of the bar-shaped key cap 54 are then disposed to slide in the slots 56.5 in the guides 56, each of ths slides having an aperture 58.2 therein. Finally, a generally C-shaped spring element 60 has its opposite ends 60.1 extending into respective apertures 58.2 in the slides and has its main body portion 60.2 press-fitted into the slots 56.6 in the guides. In this arrangement, manual pressure applied to the bar-shaped key cap 54 at any point along the length of the key cap causes the slides 58 to move downwardly in the guide slots 56.5 and to move the bridging member of the mechanism 28 attached thereto to its depressed position, this movement of the key cap 54 slightly stressing the spring 60. Then, upon release of manual pressure on the key cap, the spring 36 in the switch mechanism 28 returns the key cap to its original position, the spring 60 and the guides 56 and slides 58 assuring stable level movement of the key cap 54 during this movement. In this way, the guides 56 and slides 58 assure that manual pressure applied to the key cap 54 at a point along its length is uniformily transmitted to the mechanisms 28.

As will be understood, a cam block 44 and cam follower means 45 are adapted to be added to a switch mechanism 28 having a bar-shaped key cap if desired.

In this way, the various objectives of this invention are achieved. That is, the switch mechanisms 28 are readily adapted by the addition of cam block and cam follower means and by the addition of key caps 38 or key caps 54 to provide a variety of different types of switching actions. The switch mechanisms are adapted for repetitive manufacture and are therefore adapted to be produced in large quantities at low cost. The substrates 12 are adapted to be provided with pairs of contacts in any selected pattern and with any desired circuit paths connected to the contacts to meet the requirements for regulating operation of any of a variety of types of electrical apparatus and corresponding support members 14 are easily and economically provided with any desired number of openings 24. The switch mechanisms 28, with or without the addition of cam block and follower means and with the use of either key caps 38 or key caps 54 and associated spring guides and the like are then easily mounted on the support 14 in predetermined positions relative to the pairs of contacts on the substrate 12. In this way, any of various combinations of switching functions are provided in the keyboard 10 in an economical manner.

It should be understood that although various preferred embodiments of this invention have been described by way of illustrating the invention, this invention includes all modifications and equivalents of the described embodiments falling within the scope of the appended claims.

I claim:

1. A keyboard comprising a substrate of insulating material having a plurality of pairs of electrical contact means disposed in a selected pattern on said substrate and having circuit path means connected to said contact means, a support member secured to said substrate extending in generally parallel relation to the substrate in a plane spaced a selected distance from the substrate, said support member having a plurality of openings therein and being secured to said substrate with said openings aligned with respective pairs of said contact means on said substrate, and a plurality of switch mechanisms disposed in respective support member openings, each of said switch mechanisms having a housing which is open at one end and which has an aperture opposite said open end, having a contact element which is movable in said housing to a depressed position at said open housing end and which is biased to a retracted position within said housing, and having a plunger means which is movable in said housing to move said contact element to said depressed position and which has a portion thereof extending from said aperture to be manually engaged for moving said plunger means, said switch mechanism housings each having stop means and resilient detent means engaging respective opposite sides of said support member around said support member openings for mounting said switch mechanisms on said support member in predetermined positions relative to respective pairs of said contact means on said substrate for permitting said contact element to bridge one pair of said contact means on said substrate when said contact element is disposed in said depressed position and for disposing said contact element spaced from at least one of that pair of contact means when the contact element is in said retracted position.

2. A keyboard as set forth in claim 1 wherein said stop means comprises flange means extending around at least part of said housing intermediate said open housing end and said housing aperture, and said detent means comprise a pair of detent arms extending from said housing adjacent said opening housing end toward said stop flange means at each of two opposite sides of said housing, said arms being depressible toward said housing throughout a major part of the length of said arms to permit said arms to be depressed toward said housing during insertion of said housing into a support member opening and to permit said arms to spring away from said housing thereafter to engage said support member around said opening.

3. A keyboard as set forth in claim 2 wherein said flange means and detent arms are integrally molded with said housing.

4. A keyboard as set forth in claim 1 having cam means and cam follower means incorporated on at least one of said switch mechanisms externally of the housing of said one switch mechanism, one of said cam means and cam follower means being incorporated on said plunger means and the other of said cam means and cam follower means being incorporated on said housing of said one mechanism respectively for regulating relative movement between said plunger means and housing to permit movement of said plunger means to move said bridging contact element to said depressed position and to retain said element in said depressed position in response to a first manual movement of said plunger means and to permit subsequent movement of said plunger means to allow said bridging element to move to said retracted position under said bias in response to a second manual movement of said plunger means.

5. A keyboard as set forth in claim 1 having cam means and cam follower means on at least one of said switch mechanisms externally of the housing of said one switch mechanism for regulating relative movement between said plunger means and housing in said one switch mechanism, one of said cam means and cam follower means being incorporated on said plunger means and the other of said cam means and cam follower means being incorporated on said housing of said one mechanism respectively, said cam means having a series of cam riser surfaces separated by alternate cam shoulders recessed in a groove in said cam means to define a closed loop cam path, said cam riser surfaces having a common riser direction around said path, said groove having a pair of major portions connected at one end and extending in generally opposite directions relative to each other and having a pair of minor portions also extending in generally opposite directions to each other interconnected with each other between the opposite ends of said major path portions, said cam shoulders being disposed at intersections of said path portions, and said cam follower means being resiliently biased into said groove for permitting said follower means to move along one of said major and one of said minor path portions in sequence in response to a first manual movement and release of said plunger means to dispose and retain said bridging element in said depressed position against said bias and for permitting said follower means to move along a second major and a second minor portion of said path in sequence in response to a second manual movement and release of said plunger means to dispose and retain said bridging element in said retracted position under influence of said bias.

6. A keyboard as set forth in claim 5 wherein said cam means is secured to said switch mechanism housing and said cam follower means is secured to said plunger means for movement with said plunger means.

7. A keyboard as set forth in claim 6 wherein said cam means comprises a cam block incorporating said cam riser surfaces and cam shoulders in a groove on said cam block, said cam block being secured to said housing.

8. A keyboard as set forth in claim 7 wherein said stop flange on said one switch mechanism housing has a slot therein and wherein said cam block has a key portion press-fitted into said stop flange a slot for retaining said cam block on said housing.

9. A keyboard as set forth in claim 6 wherein said cam follower means comprises generally L-shaped spring member having a front leg thereof fitted over said extending portion of said plunger means securing said spring member to said plunger means for movement therewith and having a second leg thereof extending over said cam means groove, said second spring leg having a blade portion separated from the remainder of said second spring leg and having an aperture in said blade, and a generally C-shaped follower element having one end disposed in said blade aperture, having a portion extending between said blade and the remainder of said second leg, and having its opposite end extending into said cam means groove holding said follower element resiliently biased into said groove.

10. A keyboard as set forth in claim 1 wherein at least some of said switch mechanism have key cap means relatively larger than said housing aperture secured to said extending plunger portion externally of said switch housing for facilitating manual movement of said plunger means.

11. A keyboard as set forth in claim 1 having at least one of said support member openings disposed between two adjacent support member openings and having one of said switch mechanisms disposed in said one support member opening, having a bar-shaped key cap member secured to said plunger means in said one switch mechanism to extend over each of said adjacent support member openings for facilitating manual movement of said plunger means in said one mechanism, having guide members with mounting portions and guide portions disposed in each of said adjacent support member openings, having slide members secured to said bar-shaped key cap member adjacent each end thereof for slidable movement in said guide portions of said guide members during manual movement of said bar-shaped key cap means, and spring means interconnecting said slide members for balancing moving of said slides during manual movement of said key cap member, said mounting portions of said guide members each having stop means engaging one side of said support member and having resilient detent means extending through one of said adjacent support member openings to engage an opposite side of said support member around one of said adjacent support member openings for positioning said guide members within said openings.

12. A keyboard as set forth in claim 1 wherein said stop means of each of said guide members comprises a flange resting on said one side of said support member around one of said adjacent openings and said resilient detent means of each of said guide members comprises a pair of detent arms depending from said guide flange into said one adjacent support member opening, said arms each having a shoulder thereon engaging said opposite side of said support member around said one adjacent opening.

13. A keboard as set forth in claim 12 wherein each of said guide members has a rib upstanding from said flange, said rib having a slot therein and having one of said slides slidably movable in said slot for guiding movement of said slide.

14. A keyboard as set forth in claim 13 wherein each of said slides has an aperture therein and wherein each of said guide ribs has an additional slot therein, said spring means comprising a generally C-shaped spring element having its ends disposed in respective slide apertures and having its main body portion snap-fitted into said additional slots on said guide rib for positioning said spring means relative to said guides and slides.

15. A keyboard key device comprising a substrate of insulating material having a pair of electrical contact means disposed on said substrate and having circuit path means connected to said contact means, a support member having an opening therein secured over said substrate in spaced relation to said substrate with said opening aligned with said pair of said contact means, and a switch mechanism disposed in said support member opening, said switch mechanism having a housing which is open at one end and which has an aperture opposite said open end, having a contact element which is movable in said housing to a depressed position at said open housing end and which is biased to a retracted position within said housing, and having a plunger means which is movable in said housing to move said contact element to said depressed position and which has a portion thereof extending from said housing aperture to be manually engaged for moving said plunger means, said switch mechanism housing having stop means and resilient detent engaging respective opposite sides of said support member around said support member opening for mounting said switch mechanism on said support member in predetermined positions relative to said pair of said contact means for permitting said contact element to bridge said pair of contact means on said substrate when said contact element is disposed in said depressed position and for disposing said contact element spaced from at least one of said contact means when the contact means is in said retracted position, and cam means and cam follower means incorporated in said switch mechanism externally of said housing, one of said cam means and cam follower means being incorporated on said plunger means and the other of said cam means and cam follower means being incorporated on said housing of said mechanism respectively for regulating relative movement between said plunger means and housing to permit movement of said plunger means to move said bridging element to said depressed position and to retain said element in said depressed position in response to a first manual movement of said plunger means and to permit subsequent movement of said plunger means to allow said bridging element to move to said retracted position under said bias in response to a second manual movement of said plunger means.

16. A keyboard key device as set forth in claim 15 wherein said cam means has a series of cam riser surfaces separated by alternate cam shoulders recessed in a groove in said cam means to define a closed loop cam path, said cam riser surfaces having a common riser direction around said path, said groove having a pair of major portions connected at one end and extending in generally opposite directions relative to each other and having a pair of minor portions also extending in generally opposite directions to each other interconnected with each other between the opposite ends of said major path portions, said cam shoulders being disposed at intersections of said path portions, and said cam follower means being resiliently biased into said groove for permitting said follower means to move along one of said major and one of said minor path portions in sequence in response to a first manual movement and release of said plunger means to dispose and retain said bridging contact element in said depressed position against said bias and for permitting said follower means to move along a second major and a second minor portion of said path in sequence in response to a second manual movement and release of said plunger means to dispose and retain said bridging contact element in said retracted position under influence of said bias.

17. A keyboard key device as set forth in claim 16 wherein said cam means is secured to said switch mechanism housing and said cam follower means is secured to said plunger means for movement with said plunger means.

18. A keyboard key device as set forth in claim 17 wherein said cam means comprises a cam block incorporating said cam riser surfaces and cam shoulders in a groove in said cam block, said cam block being secured to said housing.

19. A keyboard key device as set forth in claim 18 wherein said switch mechanism housing has a flange therein, said flange having a slot therein and wherein said cam block has a key portion press-fitted into said flange slot for retaining said cam block on said housing.

20. A keyboard key device as set forh in claim 19 wherein said cam follower means comprises generally L-shaped spring member having a first leg thereof fitted over said extending portion of said plunger means securing said spring member to said plunger means for movement therewith and having a second leg thereof extending over said cam means groove, said second spring leg having a blade portion separated from the remainder of said second spring leg and having an aperture in said blade, and a generally C-shaped follower element having one end disposed in said blade aperture, having a portion extending between said blade and the remainder of said second leg, and having its opposite end extending into said cam means groove holding said follower element resiliently biased onto said groove.

21. A keyboard key device as set forth in claim 15 having key cap means relatively larger than said housing aperture secured to said extending plunger portion externally of said switch housing for facilitating manual movement of said plunger means.

22. A keyboard key device comprising a substrate of insulating material having a pair of electrical contact means disposed on said substrate and having circuit path means connected to said contact means, a support member having an opening therein secured over said substrate in spaced relation to said substrate with said opening aligned with said pair of said contact means, and a switch mechanism disposed in said support member opening, said switch mechanism having a housing which is open at one end and which has an aperture opposite said open end, having a contact element which is movable in said housing to a depressed position at said open housing end and which is biased to a retracted position within said housing, and having a plunger means which is movable in said housing to move said bridging element to said depressed position and which has a portion thereof extending from said housing aperture to be manually engaged for moving said plunger means, said switch mechanism housing having stop means and resilient detent means engaging respective opposite sides of said support member around said support member opening for mounting said switch mechanism on said support member in predetermined position relative to said pair of said contact means, said one support member opening being disposed between two adjacent support member openings and having said switch mechanism disposed in said one support member opening, having a bar-shaped key cap member secured to said plunger means in said switch mechanism to extend over each of said adjacent support member openings for facilitating manual movement of said plunger means in said mechanism, having guide members with mounting portions and guide portions disposed in each of said adjacent support member openings, having slide members secured to said bar-shaped key cap member adjacent each end thereof for slidable movement in said guide portions of said guide members during manual movement of said bar-shaped key cap means, and having spring means interconnecting said slide members for balancing moving of said slides during manual movement of said key cap member, said mounting portions of said guide members each having stop means engaging one side of said support member and having resilient detent means extending through one of said adjacent support member openings to engage an opposite side of said support member around one of said adjacent support member openings for positioning said guide members within said openings.

23. A keyboard key device as set forth in claim 22 wherein said means supporting each of said guide members on said support member comprises a flange resting on one side of said support member around one of said adjacent openings and resilient detent means depending from said guide flange into said one adjacent opening, said arms each having a shoulder thereon engaging an opposite side of said support member around said one adjacent opening.

24. A keyboard key device as set forth in claim 23 wherein each of said guide members has a rib upstanding from said flange, said rib having a slot therein and having one of said sides slidably movable in said slot for guiding movement of said slide.

25. A keyboard key device as set forth in claim 24 wherein each of said slides has an aperture therein and wherein each of said guide ribs has an additional slot therein, said spring means comprising a generally C-shaped spring element having its ends disposed in respective slide apertures and having its main body portion snap-fitted into said additional slots on said guide rib for positioning said spring means relative to said guides and slides.

* * * * *